US006083652A

United States Patent [19]

Duggan et al.

[11] Patent Number: 6,083,652

[45] Date of Patent: Jul. 4, 2000

[54] COATED CARRIERS

[75] Inventors: Michael J. Duggan, Webster; Scott M. Silence, Fairport; K. Derek Henderson, Rochester; John G. VanDusen, Walworth, all of N.Y.

[73] Assignee: Xerox Corporation, Stamford, Conn.

[21] Appl. No.: 09/259,598

[22] Filed: Mar. 1, 1999

[51] Int. Cl.[7] ..... G03G 9/113

[52] U.S. Cl. ..... 430/106.6; 430/108

[58] Field of Search ..... 430/106.6, 108

[56] References Cited

U.S. PATENT DOCUMENTS

| | | | |
|---|---|---|---|
| 4,233,387 | 11/1980 | Mammino et al. | 430/137 |
| 4,238,558 | 12/1980 | Ziolo | 430/108 |
| 4,264,697 | 4/1981 | Perez et al. | 430/107 |
| 4,310,611 | 1/1982 | Miskinis | 430/107 |
| 4,397,935 | 8/1983 | Ciccarelli et al. | 430/110 |
| 4,434,220 | 2/1984 | Abbott et al. | 430/108 |
| 4,810,611 | 3/1989 | Ziolo et al. | 430/106.6 |
| 4,935,326 | 6/1990 | Creatura et al. | 430/108 |
| 4,937,166 | 6/1990 | Creatura et al. | 430/108 |
| 5,272,037 | 12/1993 | Ohtani et al. | 430/108 |
| 5,376,494 | 12/1994 | Mahabadi et al. | 430/137 |
| 5,744,275 | 4/1998 | Duggan et al. | 430/108 |
| 5,821,022 | 10/1998 | Ohishi et al. | 430/108 |
| 5,821,023 | 10/1998 | Shibuya et al. | 430/108 |
| 5,849,448 | 12/1998 | Yoshino et al. | 430/108 |

*Primary Examiner*—Christopher D. RoDee
*Attorney, Agent, or Firm*—E. O. Palazzo

[57] ABSTRACT

A carrier composition comprised of a core and coating thereover comprised of a polymer composite, a conductive component, and a matrix resin, and a second resin free of said conductive component.

23 Claims, No Drawings

COATED CARRIERS

PENDING APPLICATIONS AND PATENTS

Illustrated in U.S. Pat. No. 5,945,244, U.S. Ser. No. 140,524 now U.S. Pat. No. 6,042,981, and U.S. Pat. No. 6,004,762 the disclosures of each of which are totally incorporated herein by reference, are carrier particles comprised, for example, of a core with various coatings thereover such as polystyrene/olefin/dialkylaminoalkyl methacrylate, polystyrene/methacrylate/dialkylaminoalkyl methacrylate, and polystyrene/dialkylaminoalkyl methacrylate.

The appropriate components and processes of the copending applications can be selected for the present invention in embodiments thereof.

BACKGROUND OF THE INVENTION

This invention is generally directed to developer compositions, and more specifically, the present invention relates to developer compositions with coated carrier components, or coated carrier particles that can be prepared by, for example, dry powder processes. More specifically, the present invention relates to compositions, especially carrier compositions comprised of a core, a polymer composite coating comprised of a matrix resin into which a conductive component will fully disperse, a conductive component, and a resin wherein the conductive component is fully excluded from, that is, microscopic examination of the composite indicates that all of the conductive component is present in the first resin and the conductive component is not present in the second, or exclusion phase, resin. Further, the triboelectric potential of the exclusion phase resin is high, imparting a triboelectric charge to a toner in excess of about 30 microcoulombs per gram, preferably greater than about 40 microcoulombs per gram, at concentrations of, for example, below 40 percent by weight, and preferably about 20 percent by weight, of the exclusion phase resin in the polymer composite. The confinement of the conductive component to one of the two resins in the composite reduces the concentration of the conductive component necessary to achieve high composite conductivity. Preferred ranges for each of the components in the composite are from about 5 to about 17 percent by weight of the conductive component, from about 5 to about 45 percent by weight of the exclusion phase polymer, and from about 90 to about 38 percent by weight of the matrix resin into which the conductive component is fully dispersed. More specifically, the polymer composite is comprised of matrix resin, such as a crosslinked polyester-polyurethane, available as Envirocron, a conductive filler, of for example carbon black, and an exclusion phase resin, such as crosslinked melamine resin particles.

The primary function of the matrix resin is to bond the composite constituents to the carrier core surface such that the composite is substantially uniform and mechanically tough; that is, resistant to separation from the core via chipping, flaking, or peeling and resistant to abrasion, or gradual wearing of the surface of the polymer on the carrier. The matrix resin should combine excellent mechanical properties with acceptable flow and coating characteristics. The primary function of the conductive component is to create a conductive path through the polymer coating to allow charge transport between contacting carrier particles, and the primary function of the high triboelectric exclusion phase, for example the melamine crosslinked resin particles is to provide a high triboelectric charging site on the surface of the carrier beads to charge toner, and at the same time segregate carbon black (or other conductive fillers) from the polymer matrix resin. Exclusion of the conductive additive from the exclusion phase resin results in a more conductive carrier at a given concentration of carbon black in the composite by concentrating the conductive phase in the resin matrix; specifically, 10 percent carbon black by weight in the composite results in a carrier conductivity of $6\times10^{-12}$ mho/cm in the absence of an exclusion phase resin and $9.8\times10^{-9}$ mho/cm with the inclusion of 40 percent (percent by weight) melamine exclusion phase resin. Alternatively, segregation of the conductive additive from the exclusion phase resin results in equivalent conductivity at a lower concentration of carbon black in the composite; specifically 15 percent carbon black by weight in the composite results in a carrier conductivity of $3\times10^{-9}$ mho/cm in the absence of an exclusion phase resin and 10 percent carbon black by weight in the composite results in a conductivity of $9.8\times10^{-9}$ mho/cm with the inclusion of 40 percent melamine exclusion phase resin. Although the invention is not be limited by theory, it is believed that the presence of the exclusion phase resin concentrates the conductive additive in the matrix resin phase increasing the contacts between adjacent conductive additive particles, effectively lowering the conductive additive concentration at which the composite will conduct electricity, defined as the percolation threshold. Specifically, the concentration of conductive additive drops from greater than about 15 percent by weight, and preferably greater than about 20 percent by weight in the absence of an exclusion phase resin, to less than about 12 percent, and preferably less than about 8 percent by weight in the presence of an exclusion phase resin, when the exclusion phase resin is present in the composite at a concentration of greater than about 10 percent, preferably greater than about 20 percent, and most preferably greater than about 30 percent by weight of the total composite.

Also, and more specifically, in the presence of the conductive component there is enabled carriers with increased developer triboelectric response, for example equal to or greater than about 25 microcoulombs per gram of toner, preferably about 35 to about 80 microcoulombs per gram of toner, and most preferably greater than 45 microcoulombs per gram of toner, at relative humidities of from about 20 to about 90 percent, improved image quality performance, excellent high conductivity ranges of from about $10^{-10}$ to about $10^{-7}$ $(\text{ohm-cm})^{-1}$, and the like. An important advantage associated with the carriers of the present invention include a high triboelectrical charge, for example a carrier tribo range of from about a plus (positive charge) 20 to about 100, and preferably from about a positive 20 to about a positive 90 microcoulombs per gram, and most preferably from a positive about 25 to a positive about 50 microcoulombs per gram.

The carrier particles of the present invention can be selected for a number of different xerographic copiers and printers, such as high speed color xerographic copies, printers, digital copiers, and more specifically wherein colored copies with excellent and substantially no background deposits are achievable. Developer compositions comprised of the carrier particles illustrated herein are generally useful in electrostatographic or electrophotographic imaging systems, especially xerographic imaging and printing processes, and digital processes. Additionally, the invention developer compositions comprised of substantially conductive carrier particles are useful in imaging methods wherein relatively constant conductivity parameters are desired. Furthermore, in the aforementioned imaging processes the triboelectric charge on the carrier particles can be preselected depending on the polymer composition and conductive component selected.

Advantages of the carriers of the present invention include in embodiments high robust carrier tribo charge of a positive value, high toner tribo charge of preferably a negative value, excellent admix, for example, from about 1 to about 30 seconds as determined in the charge spectrograph, and the like. More specifically, the toner tribo is from about a minus 50 to about a minus 150, from about a minus 55 to about a minus 90, or from about a minus 60 to about a minus 85, with corresponding positive tribo charges for the carrier. The tribo charges can be determined by a number of known methods, such as the use of a Faraday Cage.

Other advantages of the present invention include increased resistance of the carrier to mechanical aging in a xerographic environment and a decreased sensitivity of the carrier triboelectric value to the relative humidity of the environment. With respect to high toner tribo charge of a negative value, this property is important to xerographic, especially color applications, primarily because there is enabled development of toner particles into regions of the imaging member, such as a photoreceptor where strong fringe electrical fields exist, that is, at the borders of solids areas and lines. Developing toner particles through these fringe fields minimizes or eliminates the untoned part of the image which appears between two adjacent colors in an image.

PRIOR ART

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith.

Carrier particles for use in the development of electrostatic latent images are described in many patents including, for example, U.S. Pat. No. 3,590,000. These carrier particles can contain various cores, including steel, with a coating thereover of fluoropolymers, terpolymers of styrene, methacrylate, and silane compounds, and the like. A number of these coatings can deteriorate rapidly, especially when selected for a continuous xerographic process where part of, or the entire coating may separate from the carrier core in the form of chips or flakes, and fail upon impact, or abrasive contact with machine parts and other carrier particles. These flakes or chips, which cannot generally be reclaimed from the developer mixture, usually adversely effect the triboelectric charging characteristics of the carrier particles, thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity, and relatively low triboelectric values.

There are illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic or thermosetting resin particles. The resulting mixture is then dry blended until the resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the resin particles to melt and fuse on the carrier core.

There is illustrated in U.S. Pat. Nos. 4,937,166 and 4,935,326, the disclosures of which are totally incorporated herein by reference, carrier containing a mixture of polymers, such as two polymers, not in close proximity in the triboelectric series. Moreover, in U.S. Pat. No, 4,810,611, the disclosure of which is totally incorporated herein by reference, there is disclosed the addition to carrier coatings of colorless conductive metal halides in an amount of from about 25 to about 75 weight percent, such halides including copper iodide, copper fluoride, and mixtures thereof.

Other U.S. Patents that may be of interest include U.S. Pat. No. 3,939,086, which illustrates steel carrier beads with polyethylene coatings; U.S. Pat. No. 4,264,697, which discloses dry coating and fusing processes; U.S. Pat. Nos. 3,533,835; 3,658,500; 3,798,167; 3,918,968; 3,922,382; 4,238,558; 4,310,611; 4,397,935; and 4,434,220, the disclosures of each of these patents being totally incorporated herein by reference.

SUMMARY OF THE INVENTION

It is a feature of the present invention to provide toner and developer compositions with carrier particles containing polymer coatings.

In another feature of the present invention there are provided dry coating processes for generating carrier particles of substantially constant conductivity parameters.

In yet another feature of the present invention there are provided carrier particles of substantially constant conductivity parameters, and high triboelectric charging values.

In yet a further feature of the present invention there are provided carrier particles with excellent stable tribo values of from about 20 to about 50 microcoulombs per gram of toner.

Moreover, in another feature of the present invention there are provided carrier particles that are conductive and high charging triboelectrically; and also to provide carrier particles with high conductivity with reduced amount of conductive component.

Aspects of the present invention relate to a carrier composition comprised of a core and coating thereover comprised of a polymer composite, a conductive component, and a matrix resin, and a second resin free of the conductive component; a carrier wherein there is present from about 5 to about 17 percent by weight of the conductive component, from 5 about to about 45 percent by weight of the second resin, and from about 90 to about 38 percent by weight of the matrix resin; a carrier comprised of a core and a coating thereover comprised of a matrix polymer containing conductive filler particles, and a component which possesses a higher triboelectric charge than the conductive filler; a carrier wherein the component is polymer; a carrier wherein the second component is a crosslinked polymer; a carrier wherein the component is comprised of a crosslinked melamine polymer resin, or a copolymer of methylmethacrylate (MMA) and diisopropylaminoethyl methacrylate (DIAEMA), in amounts of from about 1 weight percent to about 60 weight percent, and which carrier possesses a triboelectrical charge range of from about 20 to about 100 □C/gram; a carrier wherein the component is comprised of an organic additive; a carrier wherein the matrix polymer is a thermoplastic; a carrier wherein the matrix polymer is a thermosetting resin; a carrier wherein the matrix polymer is a thermosetting resin which contains, for example, from about 75 to about 95 of a polyester polymer, which when combined with an appropriate crosslinking agent forms a crosslinked poly(urethane) resin at elevated temperatures; a carrier wherein the conductive filler is carbon black; a carrier wherein the conductive filler is a metal oxide; a carrier wherein the conductive filler is a metal; a carrier wherein the filler is present in an amount of about 1 to about 75 weight percent; a carrier wherein the conductive filler is present in an amount of about 20 to about 50 weight percent; a carrier wherein the conductive filler is present in a small amount of about 1 to about 10 weight percent; a carrier wherein the polymer coating weight is from about 1 to about 3 weight percent; a carrier wherein the core is a metal, a metal oxide, or a ferrite; a carrier with a triboelectric charge of from about a positive 20 to about a positive 50 microcoulombs per gram; a developer comprised of the carrier and toner; a developer wherein the toner is comprised of thermoplastic resin and colorant; a developer wherein the colorant is a pigment and the resin is a styrene polymer, or a polyester; a developer comprised of (1) a carrier comprised of a core and a coating thereover comprised of a matrix polymer containing a conductive component, and a polymer component which possesses a higher triboelectric charge than the conductive component, and (2) a toner; a developer wherein the carrier core is selected from the group consisting of iron, ferrites, steel and nickel; a carrier wherein the carrier further contains a second polymer coating; a carrier wherein the second coating is comprised of styrene acrylate, styrene methacrylate, or a fluoropolymer; a carrier wherein the second coating is comprised of a polyurethane, and which polyurethane optionally contains dispersed therein conductive components; a carrier wherein the second coating is comprised of a polyurethane/polyester with carbon black dispersed therein; developer compositions comprised of toner, and carrier particles preferably prepared, for example, by a powder coating process, and wherein the carrier particles are comprised of a core with certain coatings thereover. More specifically, the carrier particles selected can be prepared by mixing low density porous magnetic, or magnetically attractable metal core carrier particles with from, for example, between about 0.05 percent and about 3 percent by weight, based on the weight of the coated carrier particles, with the polymer coating illustrated herein, until adherence thereof to the carrier core by mechanical impaction or electrostatic attraction; heating the resulting mixture of carrier core particles and polymer to a temperature, for example, of between from about 200° F. to about 625° F., preferably about 400° F. for an effective period of, for example, from about 10 minutes to about 60 minutes enabling the polymer to melt and fuse to the carrier core particles; cooling the coated carrier particles; and thereafter, classifying the obtained carrier particles to a desired particle size of, for example, from about 50 to about 200 microns in diameter.

The carrier coating can be comprised of a polymer composite of (1) a matrix polymer, and contained therein (2) conductive filler components, and (3) a high tribo polymer resin phase resin from which the conductive component is fully excluded; that is, microscopic examination of the composite indicates that all of the conductive component is present in the matrix polymer resin and no part of the conductive component is present in the second, or exclusion phase, resin. The carrier coating is typically from about 0.2 micron to about 2 microns in thickness and can vary from 0.05 to about 5 percent by weight of the carrier, depending on the carrier size and morphology. The matrix polymer (component 1) can be comprised of, for example, from about 30 to about 90 percent, and preferably from about 45 to 85 percent by weight of the total composite of a thermoplastic resin, such as polystyrene, polymethylmethacrylate, polyesters such as linear bisphenol-A propylene oxide fumarate, or like branched polymer, fluoropolymers such as polyvinylidene fluoride, and the like, a thermosetting resin such as a polyester-polyurethane, (for example Envirocron), epoxies, acrylics, alkyds, hybrid combination of thermosetting resins, and the like. The matrix polymer primarily binds the other components together and to the carrier core, it should, therefore, be mechanically robust and easy to coat.

The matrix resin can comprise from about 30 to about 90 percent of the coating, and preferably from about 45 and about 85 weight percent. The conductive filler (component 2) can be comprised of any conductive powder with a primary volume median particle size of, for example, less than about 500 nanometers, and preferably less than about 100 nanometers, such as from about 10 to about 75, examples of such component carbon black, tin oxides preferably doped with about 5 and 20 percent by weight of antimony or indium, ZnO, metal halides (such as CuI), or metals such as Ni, Cu, Ag, Al, Au Fe. The conductive filler can comprise between 2 and 40 percent (weight percent) of the coating, and preferably about 5 to about 25 percent. The conductive filler particles typically have a conductivity range of from about $5\times10^{-4}$ to about $5\times10^{-7}$ Mho/cm. The high tribo exclusion phase (component 3 ) can be comprised of a powder with a primary volume median particle size of less than about 1 micron, and preferably less than 500 nanometers, such as from about 25 to about 300, that charges to a high triboelectric value against a toner and wherein the conductive additive is not present in, that is, is fully excluded from during either incorporation of the exclusion phase polymer and conductive additive into the matrix polymer by chemical or thermal processing techniques, such as extrusion, subsequent polymer processing steps such as size reduction of the powder in preparation for the powder coating carrier manufacturing process or thermal processing of the polymer composite onto the surface of the carrier core in the carrier manufacturing process. The exclusion phase can be either organic, such as polymeric, in composition or inorganic such as ceramic, in composition. More specifically, it is preferred that the exclusion phase be composed of particles with an average volume median diameter of less than about 1 micron, preferably less than abut 500 nanometers, to ensure that the exclusion phase resin is an integral part of the carrier coating and will not easily detach from the surface of the carrier in, for example, a xerographic print engine environment. Also, it is important that the melt rheology of the matrix polymer and the exclusion polymer be sufficiently different at the process temperatures at which the conductive element and exclusion phase resin are incorporated into the matrix polymer and that no part of the conductive additive is dispersed into the exclusion phase polymer. More specifically, at the processing temperatures a difference in melt viscosity between the matrix polymer and the exclusion phase polymer is greater than 10 cP, preferably greater than 100 cP, and most preferably greater than about 1,000 cP such as from about 1,000 to about 5,000.

Examples of exclusion phase materials include crosslinked melamine resins, polyurethane resins, uncrosslinked or partially crosslinked acrylate polymers such as polymethylmethacrylate or copolymers of methylmethacrylate (MMA) and diisopropylaminoethyl methacrylate (DIAEMA), flouropolymer resins such as polyvinylidene fluoride, inorganic oxides such as $SiO_2$, $TiO_2$, $Al_2O_3$, $BaTiO_3$, and the like. In embodiments, at a temperature of 200° F., the viscosity of a thermosetting polyester-polyurethane resin (Envirocron PCU10101, obtained from PPG Industries) used as a matrix resin in the present invention is about 1,000 centipoise, and the viscosity of crosslinked melamine polymer particles (Epostar Type S, obtained from Nippon Shokubai Co., Ltd.) used as an exclusion phase in the present invention is greater than about $1\times10^8$ centipoise. The exclusion phase can comprise from 1 to 60 percent of the coating, and preferably about 5 to about 40 percent. The exclusion phase should also impart a high triboelectric charge to toner particles when contacted with the carrier particles, preferably greater than 20 microcoulombs per gram of toner, more preferably greater than 30 microcoulombs per gram of toner, most preferably greater than 40 microcoulombs per gram of toner, for example from about 40 to about 100.

Aspects of the present invention include a composition comprised of a core, and thereover the coating illustrated herein, in an amount of, for example, from about 0.05 to about 3 weight percent of the total carrier composition, and wherein the conductive component thereof is selected in an amount of from about 10 to about 75 weight percent; a carrier with two, or more, such as 5, and preferably two polymers, of which the composite described herein comprises the first polymer, thereover, and wherein the conductive component for either the first or second polymer is a metal oxide, or a pigment, like preferably carbon black, and preferably wherein the conductive component is carbon black selected in an amount of from about 10 to about 50 weight percent, and wherein the second polymer is as illustrated herein, that is for example, a fluorocarbon, polymethylmethacrylate (PMMA), a thermosetting polymer such as a thermosetting polyurethane, a polyester, a styrene based polymer, and, wherein the first polymer is selected in an amount of from about 1 to about 100, or from about 10 to about 75 weight percent, based on the total weights of all polymers and the conductive components present in the carrier and the second polymer is selected in an amount of from about 99 to about 0, or from about 90 to about 25 weight percent, based on the total weights of all polymers; and wherein the carrier core is a metal, a ferrite, a metal oxide, and the like such as known carrier cores.

When resin coated carrier particles are prepared by powder coating process the majority of the coating materials are fused to the carrier surface thereby reducing the number of toner impaction sites on the carrier material. Additionally, there can be achieved with the process of the present invention and the carriers thereof, independent of one another, desirable triboelectric charging characteristics and conductivity values; that is, for example, the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected high triboelectric charging characteristics and/or conductivity values in a number of different combinations. Thus, for example, there can be formulated in accordance with the invention of the present application carriers with conductivities of from about $10^{-6}$ (ohm-cm)$^{-1}$ to about $10^{-17}$ (ohm-cm)$^{-1}$, preferably from about $10^{-10}$ (ohm-cm)$^{-1}$ to about $10^{-6}$ (ohm-cm)$^{-1}$, and most preferably from about $10^{-8}$ (ohm-cm)$^{-1}$ to about $10^{-6}$ (ohm-cm)$^{-1}$, determined in a magnetic brush conducting cell, and high carrier triboelectric charging value of from a positive triboelectric charge of positive about 20 to a positive of about 80, and, for example, from a positive about 25 to a positive about 50, microcoulombs per gram on the carrier particles as determined by the known Faraday Cage technique. Thus, the developers of the present invention can be formulated with conductivity values in a certain range with different triboelectric charging characteristics by, for example, maintaining the same total coating weight on the carrier particles and contained therein conductive particles of for example, carbon black.

Various suitable solid carrier cores can be selected for the carriers and developers of the present invention. Characteristic core properties of importance include those that will enable the toner particles to acquire a positive charge or a negative charge, mechanical stable, robust, permit adhesion of the coating, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and additionally wherein the carrier cores possess desirable mechanical aging characteristics, and a suitable core surface morphology to permit high electrical conductivity of the developer comprising the carrier and a suitable toner. Examples of carrier cores that can be selected include suitable metals, suitable metal oxides, and the like, such as iron, steel, ferrites such as Sr (strontium)-ferrite, Ba-ferrite, Cu/Zn-ferrite, and Ni/Zn-ferrite, magnetites, nickel, mixtures thereof, and the like. Preferred carrier cores include ferrites, and sponge iron, or steel grit with an average particle size diameter of from between about 30 microns to about 200 microns.

The polymer coating matrix has dispersed therein conductive components, such as metal oxides like tin oxide, conductive carbon blacks, and the like, in suitable amounts of, for example, from about 1 to about 70 and preferably from about 15 to about 60 weight percent and more preferably small amounts can be selected, such as from about 1 to about 5 weight percent. Specific examples of conductive components include the conductive carbon black SC Ultra available from Conductex, Inc., and antimony-doped tin oxide Zelec ECP3005-XC manufactured by E.I. DuPont.

Also, the carrier coating can have incorporated therein various known charge enhancing additives, such as quaternary ammonium salts, and more specifically, distearyl dimethyl ammonium methyl sulfate (DDAMS), bis[1-[(3,5-disubstituted-2-hydroxyphenyl)azo]-3-(mono-substituted)-2-naphthalenolato(2)]chromate(1-), ammonium sodium and hydrogen (TRH), cetyl pyridinium chloride (CPC), FANAL PINK® D4830, and the like, including those as specifically illustrated herein, and other effective known charge agents or additives. The charge additives are selected in various effective amounts, such as from about 0.05 to about 15, and from about 0.1 to about 3 weight percent, based on the sum of the weights of all polymer, conductive additive, and charge additive components.

Moreover optionally, the polymer composite comprised of a matrix polymer, conductive additive, and exclusion phase polymer can be combined with a second distinct polymer or polymer composite during the carrier coating process. Examples of second polymers selected can include poly monoalkyl or dialkyl methacrylates or acrylates, polyurethanes, fluorocarbon polymers such as polyvinylidene fluoride, polyvinylfluoride, and polypentafluorostyrene, polyethylene, polyethylene-co-vinylacetate, polyvinylidene fluoride-co-tetrafluoroethylene, and the like. Other known related polymers not specifically mentioned herein may also be selected, such as those illustrated in the U.S. Pat. Nos. 4,937,166 and 4,935,326 patents mentioned herein.

Optionally, the second polymer can be comprised of one or more of the three distinct components of the first polymer composite. An example of such a second polymer is a thermosetting polymer, and more specifically a poly (urethane) thermosetting resin which contains, for example, from about 75 to about 95, and preferably about 80 percent by weight of a polyester polymer, which, when combined with an appropriate crosslinking agent such as isopherone diisocyanate and initiator such as dibutyl tin dilaurate forms a crosslinked poly(urethane) resin at elevated temperatures. An example of a polyurethane is poly(urethane)/polyester polymer or Envirocron (product number PCU10101, obtained from PPG Industries, Inc.). This polymer has a melt temperature of between about 210° F. and about 266° F., and a crosslinking temperature of about 345° F. This second polymer is mixed together with the first polymer matrix, generally prior to mixing with the core, which when fused forms a coating of the first and second polymers on the carrier surface. The second polymer is present in an amount of from about 0 percent to about 99 percent by weight, based on the total weight of the first and second polymers and the conductive component in the first polymer.

Various effective suitable processes can be selected to apply the polymer matrix and additional polymers, for example from about 2 to about 5, and preferably two, of polymer coatings to the surface of the carrier particles. Examples of typical processes for this purposes include combining the carrier core material, and the polymer matrix, second polymer, and conductive component by cascade roll mixing, or tumbling, milling, shaking, electrostatic powder cloud spraying, fluidized bed, electrostatic disc processing, and an electrostatic curtain. Following application of the polymer matrix, and the second polymer, or plurality of polymers, heating is initiated to permit flow out of the coating, or coatings over the surface of the carrier core. The concentration of the coating material powder particles, and the parameters of the heating step may be selected to enable the formation of a continuous film of the coating polymers on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-7}$ to about $10^{-17}$ mho-cm$^{-1}$ as measured, for example, across a 0.1 inch magnetic brush at an applied potential of 10 volts; and wherein the coating coverage encompasses from about 10 percent to about 100 percent of the carrier core. Moreover, known solution processes may be selected for the preparation of the coated carriers.

Illustrative examples of toner binders, include thermoplastic resins, which when admixed with the carrier generates developer compositions, such binders including styrene based resins, styrene acrylates, styrene methacrylates, styrene butadienes, polyamides, epoxies, polyurethanes, diolefins, vinyl resins, polyesters, such as those obtained by the polymeric esterification products of a dicarboxylic acid and a diol comprising a diphenol. Specific vinyl monomers that can be selected are styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol. Also, the crosslinked and reactive extruded polyesters of U.S. Pat. No. 5,376,494, the disclosure of which is totally incorporated herein by reference, may be selected as the toner resin.

Generally, from about 1 part to about 5 parts by weight of toner particles are mixed with from about 10 to about 300 parts by weight of the carrier particles.

Numerous well known suitable colorants, such as pigments dyes, or mixtures thereof, and preferably pigments can be selected as the colorant for the toner particles including, for example, carbon black, nigrosine dye, lamp black, iron oxides, magnetites, and mixtures thereof. The colorant, which is preferably carbon black, should be present in a sufficient amount to render the toner composition highly colored. Thus, the colorant is present in amounts of, for example, from about 1 percent by weight to about 20, and preferably from about 5 to about 12 percent by weight, based on the total weight of the toner components, however, lesser or greater amounts of pigment may be selected. Colorants include dyes, pigments, mixtures thereof, mixtures of dyes, mixtures of pigments, and the like.

When the colorant particles are comprised of magnetites, which are a mixture of iron oxides ($FeO.Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant, such as carbon black like REGAL 330®, is contained therein, about 90 percent by weight of binder material is selected. Generally, the toner composition is comprised of from about 85 percent to about 97 percent by weight of toner resin particles, and from about 3 percent by weight to about 15 percent by weight of colorant particles such as carbon black.

Also, there may be selected colored toner compositions comprised of toner resin particles, carrier particles and as colorants, such as pigments, dyes, and mixtures thereof, and preferably magenta, cyan and/or yellow particles, and mixtures thereof. More specifically, illustrative examples of magentas that may be selected include 1,9-dimethyl-substituted quinacridone and anthraquinone dye identified in the Color Index as Cl 60720, Cl Dispersed Red 15, a diazo dye identified in the Color Index as Cl 26050, Cl Solvent Red 19, and the like. Examples of cyans that may be used include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5dimethoxy-4-sulfonanilide phenylazo-4'-chloro-2,5-dimethoxy acetoacetanilide, permanent yellow FGL, and the like. Other known suitable colorants, such as reds, blues, browns, greens, oranges, food dyes, and the like can be selected. These colorants, especially pigments are generally present in the toner composition in an amount of from about 1 weight percent to about 15, and for example, from about 2 to about 12 weight percent based on the weight of the toner components of binder and pigment.

For further enhancing the charging characteristics of the developer compositions described herein, and as optional components, there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives, such as metal complexes, BONTRON E-84™, BONTRON E-88 ™, and the like. These additives are usually selected in an amount of from about 0.1 percent by weight to about 20, and for example, from about 3 to about 12 percent by weight. These charge additives can also be dispersed in the carrier polymer coating as indicated herein.

The toner composition of the present invention can be prepared by a number of known methods including melt blending the toner resin particles, and colorants of the present invention followed by mechanical attrition, in situ emulsion/aggregation/coalescence, and the like. Other methods include those well known in the art such as spray drying, melt dispersion, dispersion polymerization and suspension polymerization. In one dispersion polymerization method, a solvent dispersion of the resin particles and the pigment particles are spray dried under controlled conditions to result in the desired product. Toner particles sizes and shapes are known and include for example a toner size of from about 2 to about 25, and preferably from about 6 to about 14 microns in volume average diameter as determined by a Coulter Counter; shapes of irregular, round, spherical, and the like may be selected.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990; 4,585,884; 4,584,253, and 4,563,408, the disclosure of each patent being totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules there can be selected the aryl diamines disclosed in the aforementioned patents, such as the '990 patent. These layered members are conventionally charged negatively thus requiring a positively charged toner.

Images, especially colored images obtained with this developer composition possess, for example, acceptable solids, excellent halftones, and desirable line resolution with acceptable or substantially no background deposits, excellent chroma, superior color intensity, constant color chroma and intensity over extended time periods, such as 1,000,000 imaging cycles, and the like.

The following Examples are being provided to further define the present invention, it being noted that these Examples are intended to illustrate and not limit the scope of the present invention. Parts and percentages are by weight unless otherwise indicated.

EXAMPLE I

In the first step of the carrier coating process, a polymer composite was prepared by the following process. 682 Grams of a thermosetting polyester-polyurethane resin (Envirocron PCU10101, obtained from PPG Industries), 136 grams of a conductive carbon black (Conductex SC-Ultra, obtained from Columbian Chemical Company), and 545 grams of crosslinked melamine polymer particles (Epostar Type S, obtained from Nippon Shokubai Company, Ltd.) with a volume median diameter of 0.25 micron as measured by standard light scattering techniques were premixed by mechanical stirring and the mixture was fed into a single screw extruder (manufactured by APV, Inc.) operating at a barrel temperature of 200° F. (below the minimum crosslinking temperature of 330° F. for Envirocron), diehead temperature of 255° F., at 43 percent load, a feedrate of 6 grams per minute, and at 150 revolutions per minute. The extrudate was mechanically crushed and then ground in an O2O2 micronizer (manufactured by Fluid Energy Aljet) at a grind pressure of 106 psi and a feedrate of 8 grams per minute to achieve a volume median diameter particle size of about 5 microns as determined by standard laser diffraction techniques. The final composition of the polymer composite powder was 50 percent (weight percent) thermosetting polyester-polyurethane resin, 10 percent conductive carbon black, and 40 percent melamine beads, all by weight. The rheological properties of the materials and process set points above were selected in order to provide a final polymer powder in which the carbon black was fully dispersed in the polyester-polyurethane resin and fully excluded from the melamine resin. Specifically, at a temperature of 200° F., the viscosity of the thermosetting polyester-polyurethane resin used as a matrix resin is about 1,000 centipoise, and the viscosity of the crosslinked melamine polymer particles used as an exclusion phase is greater than $1\times10^8$ centipoise. Measurement of the dispersion by transmission electron microscopy confirmed that the desired dispersion was achieved.

In the second step of the carrier coating process, 545 grams of the ground polymer composite prepared above was mixed with 68.0 kilograms of an atomized steel powder obtained from Hoeganaes, Inc. with a volume median diameter of 77 microns, as determined by standard laser diffraction techniques. The mixing was accomplished in a Munson Minimixer blender with the following process conditions: blender speed of 17 rotations per minute, a blend time of 30 minutes, and a humidity of 7 millimeters Hg. This resulted in uniformly distributed and electrostatically attached polymer, as determined by visual observation, on the carrier core. Thereafter, the resulting carrier particles were inserted into a rotating tube furnace for a period of 35 minutes. This furnace was maintained at a temperature of 380° F. thereby causing the polymer resin to melt and fuse the powder to the core. The final product was comprised of steel carrier core with a total of 1.0 percent polymer mixture by weight on the surface with the polymer being composed of 40 percent Melamine, 10 percent carbon black, and 50 percent Envirocron by weight.

A developer composition was then prepared by mixing 200 grams of the above prepared carrier with 10 grams of a 7 micron volume median diameter (volume average diameter) cyan toner composition. The toner composition was generated from 78.38 percent by weight of a linear polyester resin (Resapol HT, obtained from Resana), 15.02 percent by weight partially of a crosslinked polyester resin, with a 30 percent (by weight) gel content, reference U.S. Pat. No. 5,376,494, the disclosure of which is totally incorporated herein by reference, obtained by the reactive extrusion of a linear bisphenol-A propylene oxide fumarate polymer, and 6.60 Sun Flush Blue pigment (obtained from Sun Chemical Company), extruded and ground by standard toner manufacturing techniques. Thereafter, the triboelectric charge on the carrier particles was determined by the known Faraday Cage process, and there was measured on the carrier a positive charge of 44.2 microcoulombs per gram. Further, the conductivity of the carrier as determined by forming a 0.1 inch long magnetic brush of the carrier particles, and measuring the conductivity by imposing a 10 volt potential across the brush was $9.8\times10^{-09}$ (mho-cm)$^{-1}$. Therefore, these carrier particles were conductive.

A first comparative carrier was prepared as follows. In the first step of the carrier coating process, a polymer composite was prepared by the following process. 1,227 Grams of a thermosetting polyester-polyurethane resin (Envirocron PCU10101, obtained from PPG Industries) and 136 grams of a conductive carbon black (Conductex SC-Ultra, obtained from Columbian Chemical Company) were premixed by mechanical stirring and the mixture was fed into a single screw extruder (manufactured by APV, Inc.) operating at the same conditions as above. The extrudate was mechanically crushed and then ground in an O2O2 micronizer (manufactured by Fluid Energy Aljet) at a grind pressure of 106 psi to achieve a volume median diameter particle size of about 5 microns as determined by standard laser diffraction techniques. The final composition of the polymer composite powder was 90 percent thermosetting polyester-polyurethane resin and 10 percent conductive carbon black, by weight. Measurement of the dispersion by transmission electron microscopy confirmed that the carbon black was fully dispersed in the polyester-polyurethane resin and there were no regions in which the carbon black was excluded. In the second step of the carrier coating process, 545 grams of the ground polymer composite prepared above were mixed with 68.0 kilograms of an atomized steel powder obtained from Hoeganaes, Inc. with a volume median diameter of 77 microns. The conditions under which the carrier was processed were substantially identical to that of the above carrier. The final product was comprised of steel carrier core with a total of 1.0 percent polymer mixture by weight on the surface with the polymer being composed of 10 percent carbon black, and 90 percent Envirocron by weight.

A developer composition was then prepared in the same manner as above. Thereafter, the triboelectric charge on the carrier particles was determined by the known Faraday Cage process, and there was measured on the carrier a charge of a positive 23.2 microcoulombs per gram (vs 44.2 microcoulombs per gram for the Example). Further, the conductivity of the carrier as determined by forming a 0.1 inch long magnetic brush of the carrier particles, and measuring the conductivity by imposing a 10 volt potential across the brush was $6\times10^{-12}$ (mho-cm)$^{-1}$(vs $9.8\times10^{-9}$ (mho-cm)$^{-1}$ for the Example). Therefore, these carrier particles were semiconductive.

Inclusion of 40 percent melamine in the polymer composite both increases the triboelectric value and the conductivity of the carrier substantially, at an equivalent concentration of carbon black in the polymer composite.

A second comparative carrier was prepared as follows. In the first step of the carrier coating process, a polymer composite was prepared by the following process. 1,159 Grams of a thermosetting polyester-polyurethane resin (Envirocron PCU10101, obtained from PPG Industries) and 205 grams of a conductive carbon black (Conductex SC-Ultra, obtained from Columbian Chemical Company) were premixed by mechanical stirring and the mixture was fed into a single screw extruder (manufactured by APV, Inc.) operating at the same conditions as above. The extrudate was mechanically crushed and then ground in an O2O2 micronizer (manufactured by Fluid Energy Aljet) at a grind pressure of 106 psi to achieve a volume median diameter particle size of about 5 microns as determined by standard laser diffraction techniques. The final composition of the polymer composite powder was 85 percent thermosetting polyester-polyurethane resin and 15 percent conductive carbon black, by weight. Measurement of the dispersion by transmission electron microscopy confirmed that the carbon black was fully dispersed in the polyester-polyurethane resin and there were no regions in which the carbon black was excluded. In the second step of the carrier coating process, 545 grams of the ground polymer composite prepared above was mixed with 68.0 kilograms of an atomized steel powder obtained from Hoeganaes, Inc. with a volume median diameter of 77 microns. The conditions under which the carrier was processed are substantially identical to that of the above carrier. The final product was comprised of steel carrier core with a total of 1.0 percent polymer mixture by weight on the surface with the polymer being composed of 15 percent carbon black, and 85 percent Envirocron by weight.

A developer composition was then prepared in the same manner as above. Thereafter, the triboelectric charge on the carrier particles was determined by the known Faraday Cage process, and there was measured on the carrier a charge of a positive 19.1 microcoulombs per gram (vs 44.2 microcoulombs per gram for the Example). Further, the conductivity of the carrier as determined by forming a 0.1 inch long magnetic brush of the carrier particles, and measuring the conductivity by imposing a 10 volt potential across the brush was $3\times10^{-9}$ (mho-cm)$^{-1}$ (vs $9.8\times10^{-9}$ (mho-cm)$^{-1}$ for the Example). Therefore, these carrier particles were conductive.

Thus, increasing the carbon black concentration in the composite to 15 percent to increase the conductivity to be comparable to that of the 50 percent Envirocron/40 percent melamine/10 percent carbon black composite further lowers the tribo to a level below that of the Envirocron/10 percent carbon black coated carrier.

EXAMPLE II

In the first step of the carrier coating process, a polymer composite was prepared by the following process. 750 Grams of a thermosetting polyester-polyurethane resin (Envirocron PCU10101, obtained from PPG Industries), 136 grams of a conductive carbon black (Conductex SC-Ultra, obtained from Columbian Chemical Company), and 477 grams of crosslinked melamine polymer particles (Epostar Type S, obtained from Nippon Shokubai Co. Ltd.) with a volume median diameter of 0.25 micron as measured by standard light scattering techniques were premixed by mechanical stirring and the mixture was fed into a single screw extruder (manufactured by APV, Inc.) operating at the same conditions as Example I. The extrudate was mechanically crushed and then ground in an O2O2 micronizer (manufactured by Fluid Energy Aljet) at a grind pressure of 106 psi to achieve a volume median diameter particle size of about 5 microns as determined by standard laser diffraction techniques. The final composition of the polymer composite powder was 55 percent thermosetting polyester-polyurethane resin, 10 percent conductive carbon black, and 35 percent melamine beads, all by weight. The rheological properties of the materials and process set points above were selected in order to provide a final polymer powder in which the carbon black was fully dispersed the polyester-polyurethane resin and fully excluded from the melamine resin. Specifically, at a temperature of 200° F., the viscosity of the thermosetting polyester-polyurethane resin used as a matrix resin is about 1,000 centipoise, and the viscosity of the crosslinked melamine polymer particles used as an exclusion phase is greater than about $1\times10^{8}$ centipoise. Measurement of the dispersion by transmission electron microscopy confirmed that the desired dispersion was achieved.

In the second step of the carrier coating process, 545 grams of the ground polymer composite prepared above was mixed with 68.0 kilograms of an atomized steel powder obtained Hoeganaes, Inc. with a volume median diameter of 77 microns. The conditions under which the carrier was processed are substantially the same as Example I. The final product was comprised of steel carrier core with a total of 1.0 percent polymer mixture by weight on the surface with the polymer being composed of 35 percent Melamine, 10 percent carbon black, and 55 percent Envirocron by weight.

A developer composition was then prepared in the same manner as above. Thereafter, the triboelectric charge on the carrier particles was determined by the known Faraday Cage process, and there was measured on the carrier a charge of a positive 38.0 microcoulombs per gram. Further, the conductivity of the carrier as determined by forming a 0.1 inch long magnetic brush of the carrier particles, and measuring the conductivity by imposing a 10 volt potential across the brush was $1.3\times10^{-8}$ (mho-cm)$^{-1}$. Therefore, these carrier particles were conductive. Comparison with the comparative carriers of Example I indicates that inclusion of 35 percent melamine in the polymer composite both increases the triboelectric value and the conductivity of the carrier substantially, at an equivalent concentration of carbon black in the polymer composite and that inclusion of increased levels of carbon black necessary to furnish higher conductivity acts to further decrease the triboelectric value of the carrier.

EXAMPLE III

In the first step of the carrier coating process, a polymer composite was prepared by the following process. 818 Grams of a thermosetting polyester-polyurethane resin (Envirocron PCU10101, obtained from PPG Industries), 68 grams of a conductive carbon black (Conductex SC-Ultra, obtained from Columbian Chemical Company), and 477 grams of crosslinked melamine polymer particles (Epostar Type S, obtained from Nippon Shokubai Co., Ltd.) with a volume median diameter of 0.25 micron as measured by standard light scattering techniques were premixed by mechanical stirring and the mixture was fed into a single screw extruder (manufactured by APV, Inc.) operating at the same conditions as Example I. The extrudate was mechanically crushed and then ground in an O2O2 micronizer (manufactured by Fluid Energy Aljet) at a grind pressure of 106 psi to achieve a volume median diameter particle size of about 5 microns as determined by standard laser diffraction techniques. The final composition of the polymer composite powder was 60 percent thermosetting polyester-polyurethane resin, 5 percent conductive carbon black, and 35 percent melamine beads, all by weight. The rheological properties of the materials and process set points above were selected in order to provide a final polymer powder in which the carbon black was fully dispersed the polyester-polyurethane resin and fully excluded from the melamine resin. Specifically, at a temperature of 200° F., the viscosity of the thermosetting polyester-polyurethane resin used as a matrix resin is about 1,000 centipoise, and the viscosity of the crosslinked melamine polymer particles used as an exclusion phase is greater than $1\times10^{8}$ centipoise. Measurement of the dispersion by transmission electron microscopy confirmed that the desired dispersion was achieved.

In the second step of the carrier coating process, 545 grams of the ground polymer composite prepared above was mixed with 68.0 kilograms of an atomized steel powder obtained from Hoeganaes, Inc. with a volume median diameter of 77 microns. The conditions under which the carrier was processed were substantially identical to that of Example I. The final product was comprised of steel carrier core with a total of 1.0 percent polymer mixture by weight on the surface with the polymer being composed of 35 percent Melamine, 5 percent carbon black, and 60 percent Envirocron by weight.

A developer composition was then prepared in the same manner as above. Thereafter, the triboelectric charge on the carrier particles was determined by the known Faraday Cage process, and there was measured on the carrier a charge of a positive 34.2 microcoulombs per gram. Further, the conductivity of the carrier as determined by forming a 0.1 inch long magnetic brush of the carrier particles, and measuring the conductivity by imposing a 10 volt potential across the brush was $3.1\times10^{-10}$ (mho-cm)$^{-1}$. Therefore, these carrier particles were conductive.

A comparative carrier was prepared as follows. In the first step of the carrier coating process, a polymer composite was prepared by the following process. 1,295 Grams of a thermosetting polyester-polyurethane resin (Envirocron PCU10101, obtained from PPG Industries) and 68 grams of a conductive carbon black (Conductex SC-Ultra, obtained from Columbian Chemical Company) were premixed by mechanical stirring and the mixture was fed into a single screw extruder (manufactured by APV, Inc.) operating at the same conditions as above. The extrudate was mechanically crushed and then ground in an O2O2 micronizer (manufactured by Fluid Energy Aljet) at a grind pressure of 106 psi to achieve a volume median diameter particle size of about 5 microns as determined by standard laser diffraction techniques. The final composition of the polymer composite powder was 95 percent thermosetting polyester-polyurethane resin and 5 percent conductive carbon black, by weight. Measurement of the dispersion by transmission electron microscopy confirmed that the carbon black was fully dispersed in the polyester-polyurethane resin and there were no regions in which the carbon black was excluded. In the second step of the carrier coating process, 545 grams of the ground polymer composite prepared above was mixed with 68.0 kilograms of an atomized steel powder obtained Hoeganaes, Inc. with a volume median diameter of 77 microns. The conditions under which the carrier was processed are substantially identical to that of the above carrier. The final product was comprised of steel carrier core with a total of 1.0 percent polymer mixture by weight on the surface with the polymer being composed of 5 percent carbon black, and 95 percent Envirocron by weight.

A developer composition was then prepared in the same manner as above. Thereafter, the triboelectric charge on the carrier particles was determined by the known Faraday Cage process, and there was measured on the carrier a charge of a positive 35.3 microcoulombs per gram (vs 34.2 microcoulombs per gram for the Example). Further, the conductivity of the carrier as determined by forming a 0.1 inch long magnetic brush of the carrier particles, and measuring the conductivity by imposing a 10 volt potential across the brush was less than $10^{-14}$(mho-cm)$^{-1}$ (vs $3.1\times10^{10-}$(mho-cm)$^{-1}$ for the Example). Therefore, these carrier particles were insulative.

Thus, inclusion of 35 percent melamine in the polymer composite increases the carrier conductivity by more than a factor of 10,000 by concentrating the carbon black into a single polymer phase with no substantial loss in the triboelectric value of the carrier.

EXAMPLE IV

In the first step of the carrier coating process, a copolymer was prepared by emulsion polymerization without added nonionic-surfactant by a process referred to as "soapless" or surfactant free emulsion polymerization ("SFP") at an overall solids content of between 15 and 30 percent by weight. Specifically a copolymer of 8 percent diisopropylaminoethyl methacrylate (DIAEMA) with 92 percent methyl methacrylate (MMA) was prepared by dissolving 2.4 grams of ammonium persulfate in 1.0 liter of distilled water, in a suitable reaction vessel, providing mechanical stirring, nitrogen atmosphere, and thermostatic control. The temperature was controlled to 75° C.±1° C. as the monomer mixture (8 percent DIAEMA/ 92 percent MMA) was metered into the reaction vessel. The suspended polymer had a resulting number median particle diameter of 0.4 to 0.90 micron as determined by standard light scattering methods. Molecular weight, $M_w$, of the resulting freeze dried powder as determined by GPC methods was 50,000 to 120,000 with $M_wD$ ($M_w/M_n$)=2.2 to 3.0.

In the second step of the carrier coating process, a polymer composite was prepared by the following process. 927 Grams of a thermosetting polyester-polyurethane resin (Envirocron PCU10101, obtained from PPG Industries), 232 grams of a conductive carbon black (Conductex SC-Ultra, obtained from Columbian Chemical Company), and 205 grams of the above prepared poly(DIAEMA-co-MMA) emulsion polymer were premixed by mechanical stirring and the mixture was fed into a single screw extruder (manufactured by APV, Inc.) operating at the same conditions as Example I. The extrudate was mechanically crushed and then ground in an O2O2 micronizer (manufactured by Fluid Energy Aljet) at a grind pressure of 106 psi to achieve a volume median diameter particle size of about 5 microns as determined by standard laser diffraction techniques. The final composition of the polymer composite powder was 68 percent thermosetting polyester-polyurethane resin, 17 percent conductive carbon black, and 15 percent poly (DIAEMA-co-MMA) emulsion polymer, all by weight. The Theological properties of the materials and process set points above were selected in order to provide a final polymer powder in which the carbon black was fully dispersed the polyester-polyurethane resin and fully excluded from the poly(DIAEMA-co-MMA) resin. Specifically, at a temperature of 200° F., the viscosity of the thermosetting polyester-polyurethane resin used as a matrix resin is about 1000 centipoise, and the viscosity of the poly(DIAEMA-co-MMA) emulsion polymer particles used as an exclusion phase is about $1\times10^5$ centipoise. Measurement of the dispersion by transmission electron microscopy confirmed that the desired dispersion was achieved.

In the third step of the carrier coating process, 545 grams of the ground polymer composite prepared above was mixed with 68.0 kilograms of an atomized steel powder obtained from Hoeganaes, Inc. with a volume median diameter of 77 microns. The conditions under which the carrier was processed are substantially identical to that of Example I. The final product was comprised of steel carrier core with a total of 1.0 percent polymer mixture by weight on the surface with the polymer being composed of 15 percent poly (DIAEMA-co-MMA) emulsion copolymer, 17 percent carbon black, and 68 percent Envirocron by weight.

A developer composition was then prepared in the same manner as above. Thereafter, the triboelectric charge on the carrier particles was determined by the known Faraday Cage process, and there was measured on the carrier a charge of a positive 47.4 microcoulombs per gram. Further, the conductivity of the carrier as determined by forming a 0.1 inch long magnetic brush of the carrier particles, and measuring the conductivity by imposing a 10 volt potential across the brush was $2.1\times10^{-8}$ (mho-cm)$^{-1}$. Therefore, these carrier particles were conductive.

Comparison with the comparative carrier of Example I shows an increase in conductivity of about a factor of 10 for an approximately equal carbon black concentration ($2.1\times10^{-8}$ (mho-cm)$^{-1}$ for the current Example vs $3\times10^{-9}$ (mho-cm)$^{-1}$ for the second comparative example in Example I, which contains 15 percent carbon black) and an increase in the triboelectric value of the carrier of 28.3 microcoulombs per gram (47.4 microcoulombs per gram for the current example vs 19.1 microcoulombs per gram for the second comparative example in Example I, which contains 15 percent carbon black).

Other embodiments and modifications of the present invention may occur to those of ordinary skill in the art subsequent to a review of the present application and the information presented herein; these embodiments modifications, and equivalents, or substantial equivalents thereof, are also included within the scope of the present invention.

What is claimed is:

1. A carrier comprised of a core and a coating thereover comprised of a matrix polymer containing (1) conductive filler particles and (2) a polymer component which possesses a higher triboelectric charge than said conductive filler, and wherein said polymer component is free of said conductive filler and is a copolymer of methylmethacrylate (MMA) and diisopropylaminoethyl methacrylate (DIAEMA).

2. A carrier in accordance with claim 1 wherein said component is a crosslinked polymer.

3. A carrier in accordance with claim 1 wherein said component is present in amounts of from about 1 weight percent to about 60 weight percent, and which carrier possesses a triboelectrical charge range of from about 20 to about 100 $\mu$C/gram.

4. A carrier in accordance with claim 1 wherein said matrix polymer is a thermoplastic.

5. A carrier in accordance with claim 1 wherein said matrix polymer is a thermosetting resin.

6. A carrier in accordance with claim 1 wherein said conductive filler is carbon black.

7. A carrier in accordance with claim 1 wherein said conductive filler is a metal oxide.

8. A carrier in accordance with claim 1 wherein said conductive filler is a metal.

9. A carrier in accordance with claim 1 wherein said filler is present in an amount of about 1 to about 75 weight percent.

10. A carrier in accordance with claim 1 wherein said conductive filler is present in an amount of about 20 about 50 weight percent.

11. A carrier in accordance with claim 1 wherein said conductive filler is present in a small amount of about 1 about 10 weight percent.

12. A carrier in accordance with claim 1 wherein the polymer coating weight is from about 1 to about 3 weigh percent.

13. A carrier in accordance with claim 1 wherein said core is a metal, a metal oxide, or a ferrite.

14. A carrier in accordance with claim 1 with a triboelectric charge of from about a positive 20 to about a positive 50 microcoulombs per gram.

15. A developer comprised of the carrier of claim 1 and toner.

16. A developer in accordance with claim 15 wherein the toner is comprised of thermoplastic resin and colorant.

17. A developer in accordance with claim 15 wherein the colorant is a pigment and the resin is a styrene polymer, or a polyester.

18. A carrier in accordance with claim 1 wherein the carrier further contains a second polymer coating.

19. A carrier in accordance with claim 18 wherein the second coating is comprised of styrene acrylate, styrene methacrylate, or a fluoropolymer.

20. A carrier in accordance with claim 18 wherein said second coating is comprised of a polyurethane, and which polyurethane optionally contains dispersed therein conductive components.

21. A carrier in accordance with claim 18 wherein the second coating is comprised of a polyurethane/polyester with carbon black dispersed therein.

22. A carrier comprised of a core and a coating thereover comprised of a polymer composite containing (1) a conductive component and (2) a second resin free of said conductive component each incorporated into a matrix resin, and wherein said matrix polymer is a crosslinked thermosetting polyester/polyurethane resin which contains from above 75 to about 95 percent by weight of th polyester polymer.

23. A carrier composition comprised of a core and a coating thereover comprised of a polymer composite containing (1) conductive component and (2) a second resin free of said conductive component each incorporated into a matrix resin, and wherein the carrier further contains a second polymer coating, and wherein the second coating is comprised of a polyurethane/polyester with carbon black dispersed therein.

* * * * *